US011371170B2

(12) United States Patent
Chen

(10) Patent No.: US 11,371,170 B2
(45) Date of Patent: Jun. 28, 2022

(54) KNITTING METHOD FOR A PROTECTIVE TEXTILE

(71) Applicant: ZHANGJIAGANG SIQI SCIENCE AND TECHNOLOGY LTD, Zhang Jia Gang (CN)

(72) Inventor: Feng Chen, Shanghai (CN)

(73) Assignee: ZHANGJIAGANG SIQI SCIENCE AND TECHNOLOGY LTD., Zhang Jia Gang (CN)

( * ) Notice: Subject to any disclaimer, the term of this patent is extended or adjusted under 35 U.S.C. 154(b) by 163 days.

(21) Appl. No.: 16/658,115

(22) Filed: Oct. 20, 2019

(65) Prior Publication Data

US 2020/0048796 A1 Feb. 13, 2020

Related U.S. Application Data

(63) Continuation of application No. 15/694,508, filed on Sep. 1, 2017, now abandoned.

(30) Foreign Application Priority Data

Aug. 15, 2017 (CN) ..... 201710696062.4

(51) Int. Cl.

| | |
|---|---|
| ***D02G 3/36*** | (2006.01) |
| ***A41D 31/24*** | (2019.01) |
| ***D02G 3/44*** | (2006.01) |
| ***D02G 3/32*** | (2006.01) |
| ***D04B 15/56*** | (2006.01) |
| ***A41D 19/015*** | (2006.01) |

(Continued)

(52) U.S. Cl.

CPC ..... *D02G 3/36* (2013.01); *A41D 19/01511* (2013.01); *A41D 31/24* (2019.02); *D02G 3/047* (2013.01); *D02G 3/328* (2013.01); *D02G 3/38* (2013.01); *D02G 3/442* (2013.01); *D04B 15/56* (2013.01); *D04B 35/02* (2013.01); *A41D 2500/10* (2013.01); *D10B 2101/20* (2013.01)

(58) Field of Classification Search

USPC ..... 57/211

See application file for complete search history.

(56) References Cited

U.S. PATENT DOCUMENTS 3,565,127 A * 2/1971 Nicely ..... D02G 3/38 87/6

4,197,695 A * 4/1980 Hughes ..... D07B 7/145 156/48

(Continued)

*Primary Examiner* — Khoa D Huynh
*Assistant Examiner* — Uyen T Nguyen
(74) *Attorney, Agent, or Firm* — Lorenz & Kopf, LLP

(57) ABSTRACT

The present disclosure provides a knitting apparatus, including: a frame; a primary yarn guide mounted on the frame; a primary yarn control rod connected to the primary yarn guide; a secondary yarn guide mounted on the frame; a secondary yarn control rod connected to the secondary yarn guide; a needle plate provided at lower ends of the primary yarn guide and the secondary yarn guide; a control cam separately drives the primary yarn control rod to control the primary yarn guide to move, and drives the secondary yarn control rod to control the secondary yarn guide to move; a tension spring connected to the control cam; and an electromagnet. A magnetic force of the electromagnet drives the tension spring to extend and retract, and further drives the control cam to rotate up and down.

12 Claims, 15 Drawing Sheets

(51) Int. Cl.

| | |
|---|---|
| ***D02G 3/04*** | (2006.01) |
| ***D02G 3/38*** | (2006.01) |
| ***D04B 35/02*** | (2006.01) |

(56) References Cited

U.S. PATENT DOCUMENTS 4,350,731 A * 9/1982 Siracusano ..... D02G 3/328 442/270
4,567,094 A * 1/1986 Levin ..... B04C 1/00 139/426 TW
4,738,124 A * 4/1988 Stoll ..... D04B 15/56 66/127
5,056,338 A * 10/1991 Asai ..... D04B 7/26 66/127
6,033,779 A * 3/2000 Andrews ..... A41D 19/01511 428/377
6,233,978 B1 * 5/2001 Gehring, Jr ..... D04B 21/165 66/195
6,581,366 B1 * 6/2003 Andrews ..... D02G 3/328 57/244
6,952,915 B2 * 10/2005 Prickett ..... D02G 3/28 57/211
8,283,563 B2 * 10/2012 Harris ..... D03D 1/0041 174/117 M
2003/0037530 A1 * 2/2003 Zhu ..... A41D 19/01505 57/246
2004/0187471 A1 * 9/2004 Andrews ..... D02G 3/38 57/232
2006/0213173 A1 * 9/2006 Kolmes ..... D02G 3/12 57/210
2008/0134412 A1 * 6/2008 Lapp ..... A41D 19/01505 2/161.8
2013/0298519 A1 * 11/2013 Smith ..... D01F 8/16 57/224
2015/0118425 A1 * 4/2015 Dapsalmon ..... D02G 3/16 442/310
2015/0181956 A1 * 7/2015 Andrews ..... A41D 19/01547 2/167
2015/0329997 A1 * 11/2015 Switzer ..... D02G 3/443 19/145.5
2017/0350044 A1 * 12/2017 Sugita ..... D02G 3/12
2018/0057972 A1 * 3/2018 Morrell ..... D02G 3/04
2018/0135211 A1 * 5/2018 Terada ..... D02G 3/12
2018/0245249 A1 * 8/2018 Yenici ..... D02G 3/367
2019/0003083 A1 * 1/2019 Carlsson ..... D02G 3/441

* cited by examiner

KNITTING METHOD FOR A PROTECTIVE TEXTILE

CROSS REFERENCE TO RELATED APPLICATIONS

This application is a continuation of U.S. non-provisional application Ser. No. 15/694,508, filed on Sep. 1, 2017, which is based upon and claims priority to Chinese Patent Application No. CN201710696062.4, filed on Aug. 15, 2017, the entire contents of which are incorporated herein by reference.

TECHNICAL FIELD

The present invention relates to a yarn and a yarn forming process thereof, further relates to a protective textile produced by using the yarn and a knitting method thereof, and additionally relates to textile equipment for knitting the protective textile.

BACKGROUND OF THE INVENTION

In recent years, there are a greater variety of protective textiles, and the development of protective textiles trends toward high and new technology industries and has become an important sign for advancements in textile technology at present. As safety awareness of people keeps increasing, demands for protective textiles keep growing on a daily basis, making it unavoidable to develop and research protective textiles. In view of the fact that people are highly susceptible to hand injuries, scholars at home and abroad are paying more attention to the research on performance of protective textiles for hands.

Currently, the American Society for Testing and Materials has updated the standard for cut resistant gloves, and has proposed the standard ANSI/ISEA 105-2016 (with cut resistant levels from A1 to A9), making the concept of cut resistant gloves more thorough and precise.

For the standard ANSI/ISEA 105-2016, a series of cut resistant yarns such as a polyethylene (PE) fiber, a steel wire, a basalt fiber, a glass fiber, a Kevlar fireproof fiber, and a Dyneema fiber are contained in cut resistant gloves in the prior art. However, practice has proved that after the foregoing fibers are manufactured into gloves, a series of negative effects, such as unstable cut resistant levels, allergy that occurs on hand skin because of fibers breaking easily, poor washability, and a poor feel of thick cut resistant gloves, may occur.

Existing yarn forming processes mainly involve three types of yarns: a core-spun yarn, a twisted yarn, and a covered yarn. The specific yarn forming processes may be shown in FIG. 1, FIG. 2, and FIG. 3. The main original material of existing cut resistant knitted gloves is a single complex yarn formed by combining yarns such as a steel wire, a basalt fiber, a glass fiber, a long PE fiber, a short PE fiber, a long Kevlar fireproof fiber, a short Kevlar fireproof fiber, a long Dyneema fiber, a short Dyneema fiber, a long aramid fiber, a short aramid fiber, a polyester fiber, a polyamide fiber, a spandex fiber, a carbon fiber, a copper fiber, and a silver fiber. By using one or more complex yarns, to achieve that the gloves can be used for operations in special environments, yarns such as an acrylic fiber, a chenille yarn, a carbon fiber, a copper fiber, a silver fiber, and a bamboo fiber may further be added for knitting in a glove knitting process. After yarn formation, the gloves are knitted with a single layer or double layers by using an automatic seamless knitting machine. This knitting method is applicable to machines with various gauges such as 7G, 10G, 13G, 15G, 18G, and 24G.

However, a cut resistant level is low in the foregoing methods. The seamless knitted gloves manufactured by adding yarns such as a polyamide fiber, a polyester fiber, and a spandex fiber to a long PE fiber can generally reach a cut resistant level only between A1 to A3 in ANSI cut testing, and the gloves are thick and heavy with a higher cut resistant level. As known from feedback information of markets, all gloves that can reach the ANSI cut resistant level A4 and above, are mainly made of a PE fiber, a Kevlar fireproof fiber, or an aramid fiber added with materials such as a glass fiber, a basalt fiber and a steel wire. However, after multiple yarns are combined, knitted gloves tend to have a stiff feel, and cannot ensure a desirable feel during operations.

In addition, skin allergy may further be caused. To increase the cut resistance of gloves, many commercially available gloves contain a glass fiber. However, after being knitted into gloves, glass fibers may break after a series of bending of a palm and fingers. The broken glass fibers can prick hand skin, and easily cause inflammation and an itch in hand skin, and may cause allergy to some extent. Cut resistant gloves are a high-value-added product, and are hardly disposed immediately after being worn only once, and may be worn again after appropriate washing. Experiments show that the breaking degree of glass fibers in gloves containing a glass fiber material reaches 83.7% after washing. Consequently, more serious allergy of hand skin may occur when the gloves are worn again.

SUMMARY OF THE INVENTION

In view of the problem that the cut resistant levels of protective textiles in the prior art cannot meet requirements of the technical standard ANSI/ISEA 105-2016, the present invention provides a yarn, a yarn forming process for the yarn, a protective textile produced by using the yarn, a knitting method and an apparatus for the protective textile, so as to produce protective textiles that can meet the market requirement for high cut resistance and do not cause skin allergy and affect use performance.

In view of the shortcomings in the prior art, the present invention provides a yarn, a yarn forming process, and a protective textile produced by using the yarn, and further provides a knitting method and textile equipment for the protective textile. Specific solutions are as follows:

A yarn, comprising a core filament and an outer-layer yarn, wherein the core filament is a tungsten wire, and the tungsten wire is covered at the center of the outer-layer yarn.

In the implementations, a core filament is mainly used as a cut resistant material.

As a preferred implementation solution, the outer-layer yarn comprises at least one of a long polyethylene (PE) fiber, a short PE fiber, a long Kevlar fireproof fiber, a short Kevlar fireproof fiber, a long Dyneema fiber, a short Dyneema fiber, a long aramid fiber, a short aramid fiber, polyester, polyamide or spandex.

As a preferred implementation solution, the outer-layer yarn further comprises at least one of acrylic, chenille, a carbon fiber, a copper fiber, a silver fiber or a bamboo fiber.

As a preferred implementation solution, a cross-sectional diameter of the tungsten wire is 18 microns to 40 microns.

As a preferred implementation solution, the yarn comprises a twisted yarn A10, a core-spun yarn A9, and a covered yarn A11.

The present invention further provides a yarn forming process for manufacturing the foregoing yarn, wherein the yarn forming process comprises a twisted yarn forming process, a core-spun yarn forming process, and a covered yarn forming process.

As a further technical solution, the twisted yarn A10 forming process comprises the following steps:

(1) using the tungsten wire having the cross-sectional diameter of 18 microns to 40 microns as a core filament; and (2) interlacing two or more outer-layer yarns with the tungsten wire as the center, to form the twisted yarn A10, wherein the outer-layer yarns comprise at least one of a long polyethylene (PE) fiber, a long aramid fiber, a long Kevlar fireproof fiber, a long Dyneema fiber, polyester, nylon, a cotton yarn, acrylic, chenille, a carbon fiber, a copper fiber, a silver fiber or a bamboo fiber.

As a further technical solution, the core-spun yarn A9 forming process comprises the following steps:

(1) using the tungsten wire having the cross-sectional diameter of 18 microns to 40 microns as a core filament; and (2) sequentially winding an outer-layer yarn with the tungsten wire as the center, to form the core-spun yarn A9, wherein the outer-layer yarn comprises one of a long PE fiber, a long aramid fiber, a long Kevlar fireproof fiber, a long Dyneema fiber, polyester, nylon, a cotton yarn, acrylic, chenille, a carbon fiber, a copper fiber, a silver fiber or a bamboo fiber.

As a further technical solution, the covered yarn A11 forming process comprises the following steps:

(1) using the tungsten wire having a cross-sectional diameter of 18 microns to 40 microns as a core filament; and (2) using one of a long PE fiber, a long aramid fiber, a long Kevlar fireproof fiber, a long Dyneema fiber, polyester, nylon, a cotton yarn, acrylic, chenille, a carbon fiber, a copper fiber, a silver fiber or a bamboo fiber as an outer-layer yarn, and using the twisted yarn A10 or the core-spun yarn A9 as another outer-layer yarn, to form the covered yarn A11 by using the twisted yarn forming process.

The present invention further provides a yarn, comprising a core filament and an outer-layer yarn, wherein the core filament is a spandex fiber, and the spandex fiber is covered by the outer-layer yarn.

As a preferred implementation solution, the outer-layer yarn comprises at least one of a long polyethylene (PE) fiber, a short PE fiber, a long Kevlar fireproof fiber, a short Kevlar fireproof fiber, a long Dyneema fiber, a short Dyneema fiber, a long aramid fiber, a short aramid fiber, a polyester fiber, a polyamide fiber or a spandex fiber.

As a preferred implementation solution, the outer-layer yarn comprises at least one of an acrylic fiber, a chenille yarn, a carbon fiber, a copper fiber, a silver fiber or a bamboo fiber.

The present invention provided a yarn forming process for manufacturing the foregoing yarn, wherein the yarn forming process comprises a twisted yarn forming process, a core-spun yarn forming process, and a covered yarn forming process.

As a further technical solution, the twisted yarn B30 forming process comprises the following steps:

(1) using a spandex fiber as a core filament; and (2) interlacing two or more outer-layer yarns with the spandex fiber as the center, to form a twisted yarn B30, wherein the outer-layer yarn comprises at least one of a long polyethylene (PE) fiber, a long aramid fiber, a long Kevlar fireproof fiber, a long Dyneema fiber, a polyester fiber, a nylon fiber, a cotton yarn, an acrylic fiber, a chenille yarn, a carbon fiber, a copper fiber, a silver fiber or a bamboo fiber.

As a further technical solution, the core-spun yarn B19 forming process comprises the following steps:

(1) using a spandex fiber as a core filament; and (2) sequentially winding an outer-layer yarn with the spandex fiber as the center, to form a core-spun yarn B19, wherein the outer-layer yarn comprises one of a long PE fiber, a long aramid fiber, a long Kevlar fireproof fiber, a long Dyneema fiber, a polyester fiber, a nylon fiber, a cotton yarn, an acrylic fiber, a chenille yarn, a carbon fiber, a copper fiber, a silver fiber or a bamboo fiber.

As a further technical solution, the covered yarn B31 forming process comprises the following steps:

(1) using a spandex fiber as a core filament; and (2) using one of a long PE fiber, a long aramid fiber, a long Kevlar fireproof fiber, a long Dyneema fiber, a polyester fiber, a nylon fiber, a cotton yarn, an acrylic fiber, a chenille yarn, a carbon fiber, a copper fiber, a silver fiber or a bamboo fiber as an outer-layer yarn, and using a twisted yarn A10 or a core-spun yarn A9 as the other outer-layer yarn, to form a covered yarn B31 by using the twisted yarn forming process.

The present invention provides a protective textile, wherein the protective textile at least includes a yarn using a tungsten wire as a core filament.

As a further technical solution, the protective textile is knitted by interlacing the yarn using a tungsten wire as a core filament and the yarn using a spandex fiber as a core filament.

The present invention further provides a knitting method for the foregoing protective textile, wherein the knitting method comprises a single-yarn knitting method and a double-yarn knitting method, the single-yarn knitting method is performed with a covered yarn A11, and the double-yarn knitting method is performed with both the yarn using a tungsten wire as a core filament and the yarn using a spandex fiber as a core filament.

As a preferred implementation solution, the yarn used in the single-yarn knitting method comprises one of a twisted yarn A10, a core-spun yarn A9 or a covered yarn A11.

The present invention further provides textile equipment for knitting the foregoing protective textile, wherein the equipment comprises a frame (22), a primary yarn guide (23), a primary yarn control rod (27), a secondary yarn guide (29), a secondary yarn control rod (28), a needle plate (21), a control cam (26), an electromagnet (24), and a tension spring (25), wherein the electromagnet (24) and the tension spring (25) control the control cam (26) to drive the primary yarn control rod (27) and the secondary yarn control rod (28) to move.

Advantages of the present invention are as follows:

Under same conditions, by comparing yarns manufactured by using a tungsten wire and one of a glass fiber, a steel wire, a Dyneema fiber, or a basalt fiber as a cut resistant material, cut resistant levels of knitted gloves are obviously different. Cut resistance data obtained by the laboratory of our company is as follows:

By testing cut resistance according to the standard ANSI/ISEA 105-2016, gloves knitted by using a yarn combining a tungsten wire as a cut resistant yarn and materials such as a PE fiber, an aramid fiber, a Kevlar fireproof fiber, a polyester fiber, a polyamide fiber, a cotton yarn, an acrylic fiber, a chenille yarn, a carbon fiber, a copper fiber, a silver fiber or/and a bamboo fiber can generally reach a cut resistant level from A3 to A5 with a weight of 1000 g to 2200 g.

By comparison, by testing cut resistance according to the standard ANSI/ISEA 105-2016, gloves knitted by using a yarn combining a glass fiber, a steel wire, a Dyneema fiber, or a basalt fiber of a same specification as a cut resistant yarn with materials such as a PE fiber, an aramid fiber, a Kevlar fireproof fiber, a polyester fiber, a polyamide fiber, a cotton yarn, an acrylic fiber, a chenille yarn, a carbon fiber, a copper fiber, a silver fiber or/and a bamboo fiber can generally reach a cut resistant level from A2 to A4 with a weight of 500 g to 1500 g.

The cross-sectional diameter of the tungsten wire is only 18 microns to 40 microns. The cross-sectional diameters of a steel wire and a basalt fiber are 30 microns to 60 microns. The cross-sectional diameters of a glass fiber and a Dyneema fiber are even greater than those of a steel wire and a basalt fiber. Therefore, for a same cut resistant level, gloves knitted by using a tungsten wire are lighter and thinner than gloves knitted by using a glass fiber, a steel wire or a basalt fiber, and can better fit hand skin, and can be operated more flexibly. For a same cut resistant level, the gloves knitted by using the tungsten wire as a cut resistant material are thinner than the gloves knitted by using a conventional cut resistant material, and the gloves knitted by using a tungsten wire that have an ANSI cut resistant level A5 are thinner than the gloves knitted by using a conventional cut resistant material that have an ANSI cut resistant level A4, and can better fit hand skin.

DETAILED DESCRIPTION OF THE INVENTION

To describe the intentions of the present invention more clearly, specific implementations of the present invention are further described below with reference to the accompanying drawings.

The American Society for Testing and Materials has updated the standard for cut resistant gloves, and has proposed the standard ANSI/ISEA 105-2016 with cut resistant levels from A1 to A9 as shown in Table 1, making the concept of cut resistant gloves more thorough and precise.

TABLE 1

Parameters for testing cut resistance in the standard ANSI/ISEA 105-2016

| Level | Weight (gram) for a cutting distance exceeding 20 mm |
|---|---|
| A1 | ≥200 |
| A2 | ≥500 |
| A3 | ≥1000 |
| A4 | ≥1500 |
| A5 | ≥2200 |
| A6 | ≥3000 |
| A7 | ≥4000 |
| A8 | ≥5000 |
| A9 | ≥6000 |

Kevlar is a brand name of an aramid fiber material product developed by the American company DuPont. The original name of the material is "poly-paraphenylene terephthalamide", and the repetitive unit of the chemical formula of Kevlar is -[—CO—C6H4-CONH—C6H4-NH—]-, where amide groups connected to a benzene ring have a para-position structure (a meta-position structure is another product with a brand name Nomex, commonly known as a fireproof fiber).

Dyneema is a well-known brand among ultra-high-molecular-weight polyethylene (UHMwPE) fiber products, and is a registered trademark of the company DSM. Dyneema can be used for commodities such as accident prevention gloves, textile fibers, semi-processed plastic fibers, and ropes.

In the following embodiments, the diameter of a tungsten wire in a yarn that contains a tungsten wire and is used in a protective textile is 18 microns to 40 microns, corresponding to levels A3 to A5 in the standard ANSI/ISEA 105-2016. That is, when the diameter of the used tungsten wire is 18 microns, the cut resistant level of the protective textile is A3. When the diameter of the used tungsten wire is 30 microns, the cut resistant level of the protective textile is A4. When the diameter of the used tungsten wire is 40 microns, the cut resistant level of the protective textile is A5.

Embodiment 1

Figure 1:
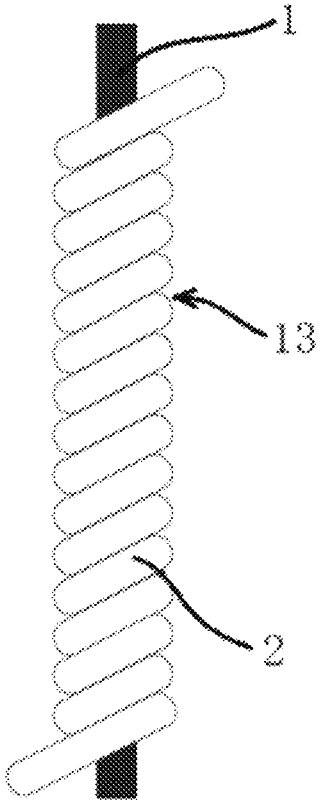
FIG. 1 is a schematic structural diagram of a core-spun yarn in the prior art.

FIG. 1 is a schematic diagram of a yarn forming process for a core-spun yarn in the prior art. Referring to FIG. 1, a first core-spun yarn 13 includes a first cut resistant material 1 and a first yarn 2. The first yarn 2 is generally referred to as an outer-layer yarn. The first core-spun yarn 13 is manufactured by winding one first yarn 2 around the first cut resistant material 1. The first cut resistant material 1 includes one of a steel wire, a basalt fiber or a glass fiber. The first yarn 2 includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber.

Embodiment 2

Figure 2:
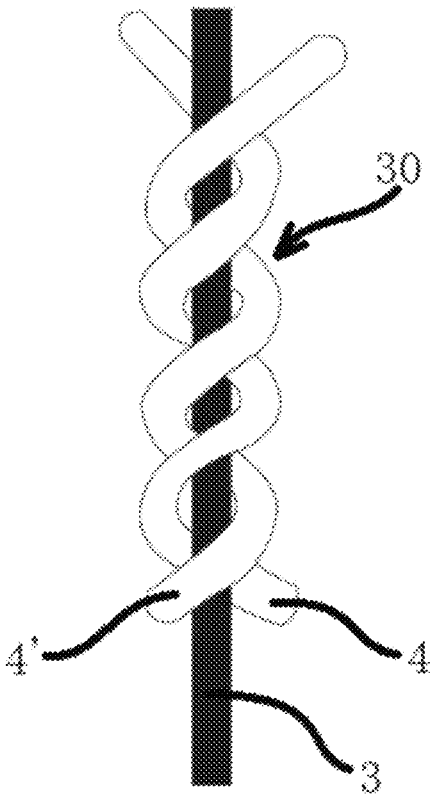
FIG. 2 is a schematic structural diagram of a twisted yarn in the prior art.

FIG. 2 is a schematic diagram of a yarn forming process for a twisted yarn in the prior art. Referring to FIG. 2, a first twisted yarn 30 includes a second cut resistant material 3, a second yarn 4 and a third yarn 4'. The second yarn 4 and the third yarn 4' are generally referred to as outer-layer yarns. The first twisted yarn 30 is manufactured by twisting and winding the second yarn 4 and the third yarn 4' around the second cut resistant material 3. The second cut resistant material 3 includes one of a steel wire, a basalt fiber or a glass fiber. The second yarn 4 or the third yarn 4' includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber.

Embodiment 3

Figure 3:
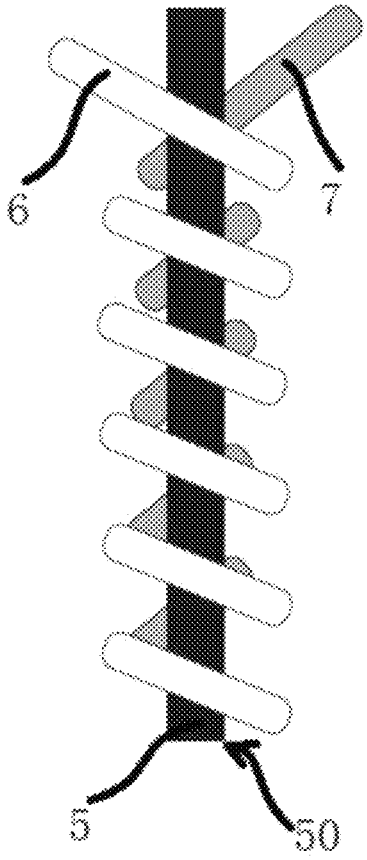
FIG. 3 is a schematic structural diagram of a covered yarn in the prior art.

FIG. 3 is a schematic diagram of a yarn forming process for a covered yarn in the prior art. Referring to FIG. 3, a first covered yarn 50 includes a third cut resistant material 5, a fourth yarn 6, and a fifth yarn 7. The fourth yarn 6 and the fifth yarn 7 are generally referred to as outer-layer yarns, and the first covered yarn 50 is manufactured by twisting and winding the fourth yarn 6 and the fifth yarn 7 around the third cut resistant material 5. The third cut resistant material 5 includes one of a steel wire, a basalt fiber or a glass fiber. The fourth yarn 6 includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber. The fifth yarn 7 is one of a first core-spun yarn 13 or a first twisted yarn 30.

None of protective textiles knitted by using the first twisted yarn, the first core-spun yarn, or the first covered yarn manufactured by using existing cut resistant materials can meet the standard ANSI/ISEA 105-2016, resulting in a series of problems such as unstable cut resistant levels, allergy that occurs on hand skin because of fibers breaking easily, poor washability, and a poor feel of thick cut resistant gloves.

In view of the existing technical shortcomings, after several researches and practices by learning from failure experience of the industry at home and abroad, and after numerous tests and experiments, our company proposes a new yarn and a new yarn forming process. Specifically, refer to embodiments shown in FIG. 4, FIG. 5, and FIG. 6.

Embodiment 4

Figure 4:
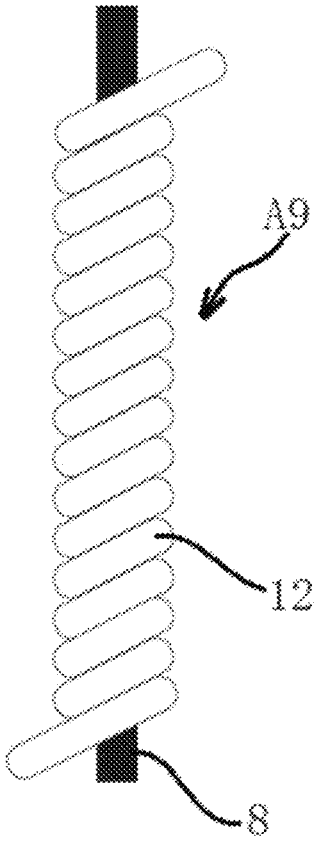
FIG. 4 is a schematic structural diagram of a core-spun yarn A9 for a tungsten-wire yarn.

FIG. 4 is a schematic diagram of a yarn forming process for a novel core-spun yarn A9. Referring to FIG. 4, the core-spun yarn A9 includes a fourth cut resistant material 8 and a sixth yarn 12. The fourth cut resistant material 8 is used as a core filament of a yarn, and the core-spun yarn A9 is manufactured by winding one sixth yarn 12 around the fourth cut resistant material 8. The fourth cut resistant material 8 is made of a tungsten wire. The sixth yarn 12 includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber.

Embodiment 5

Figure 5:
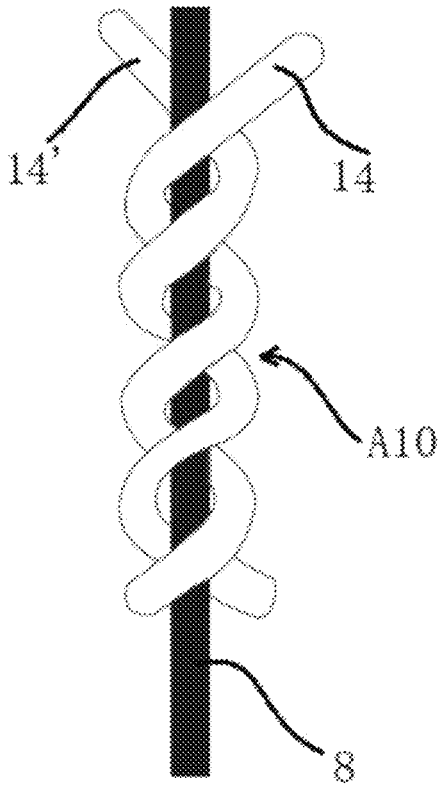
FIG. 5 is a schematic structural diagram of a twisted yarn A10 for a tungsten-wire yarn.

FIG. 5 is a schematic diagram of a yarn forming process for a novel twisted yarn A10. Referring to FIG. 5, the twisted yarn A10 includes a fourth cut resistant material 8, a seventh yarn 14, and an eighth yarn 14'. The fourth cut resistant material 8 is used as a core filament of a yarn, and the fourth cut resistant material 8 includes a tungsten wire. The twisted yarn A10 is manufactured by twisting and winding the seventh yarn 14 and the eighth yarn 14' around the fourth cut resistant material 8. The seventh yarn 14 or the eighth yarn 14' includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber.

Embodiment 6

Figure 6:
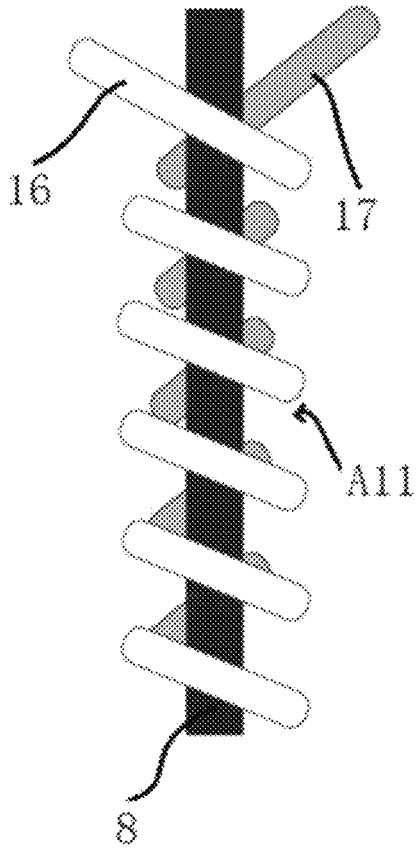
FIG. 6 is a schematic structural diagram of a covered yarn A11 for a tungsten-wire yarn.

FIG. 6 is a schematic diagram of a yarn forming process for a novel covered yarn A11. Referring to FIG. 6, the covered yarn A11 includes a fourth cut resistant material 8, a ninth yarn 16, and a tenth yarn 17. The fourth cut resistant material 8 is used as a core filament of a yarn, and the covered yarn A11 is manufactured by twisting and winding the ninth yarn 16 and the tenth yarn 17 around the fourth cut resistant material 8. The fourth cut resistant material 8 includes a tungsten wire. The ninth yarn 16 includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber. The tenth yarn 17 includes one of a core-spun yarn A9 or a twisted yarn A10.

This embodiment of the present invention provides a protective textile. The protective textile may be a body protection product such as gloves, knee pads or wrist braces. A knitting material of the protective textile includes at least one of the core-spun yarn A9, the twisted yarn A10 or the covered yarn A11. The protective textile may further include another knitting material, for example, a core-spun yarn B19, a covered yarn B31, or a twisted yarn B30 using a spandex fiber (cut resistant material) as a core filament of a yarn.

Specific embodiments of yarn forming processes for the core-spun yarn B19, the covered yarn B31, and the twisted yarn B30 are as follows.

Embodiment 7

Figure 7:
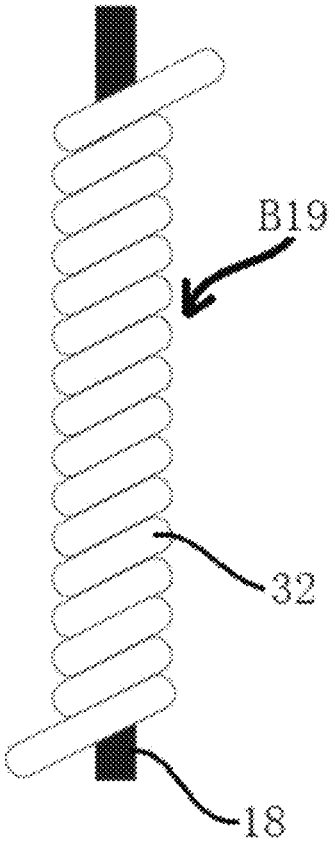
FIG. 7 is a schematic structural diagram of a core-spun yarn A19 for a spandex yarn.

FIG. 7 is a schematic diagram of a yarn forming process of a novel core-spun yarn B19 for a spandex yarn. Referring to FIG. 7, the core-spun yarn B19 includes a fifth cut resistant material 18 and an eleventh yarn 32. The fifth cut resistant material 18 is used as a core filament of a yarn, and the fifth cut resistant material 18 is made of spandex. The core-spun yarn B19 is manufactured by winding one eleventh yarn 32 around the fifth cut resistant material 18. The eleventh yarn 32 includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber.

Embodiment 8

Figure 8:
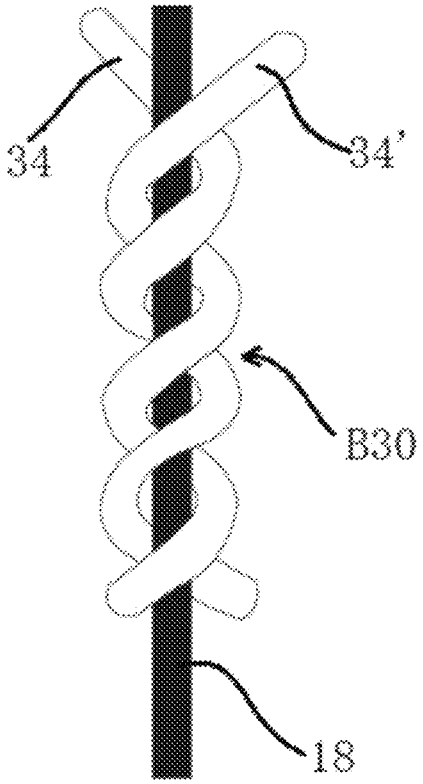
FIG. 8 is a schematic structural diagram of a twisted yarn A30 for a spandex yarn.

FIG. 8 is a schematic diagram of a yarn forming process of a novel twisted yarn B30 for a spandex yarn. Referring to FIG. 8, the twisted yarn B30 includes a fifth cut resistant material 18, a twelfth yarn 34, and a thirteenth yarn 34'. The fifth cut resistant material 18 is used as a core filament of a yarn, and the fifth cut resistant material 18 is made of spandex. The twisted yarn B30 is manufactured by twisting and winding the twelfth yarn 34 and the thirteenth yarn 34' around the fifth cut resistant material 18. The twelfth yarn 34 or the thirteenth yarn 34' includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber.

Embodiment 9

Figure 9:
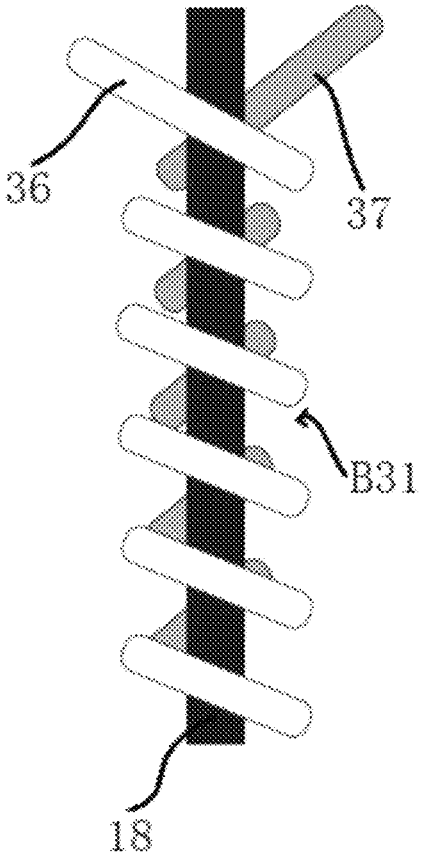
FIG. 9 is a schematic structural diagram of a covered yarn A31 for a spandex yarn.

FIG. 9 is a schematic diagram of a yarn forming process of a novel covered yarn B31 for a spandex yarn. Referring to FIG. 9, the covered yarn B31 includes a fifth cut resistant material 18, a fourteenth yarn 36, and a fifteenth yarn 37. The fifth cut resistant material 18 is used as a core filament of a yarn and is made of spandex, and the covered yarn B31 is manufactured by twisting and winding the fourteenth yarn 36 and the fifteenth yarn 37 around the fifth cut resistant material 18. The fourteenth yarn 36 includes one of a long PE fiber, a short PE fiber, a long Kevlar fiber, a short Kevlar fiber, a long Dyneema fiber, a short Dyneema fiber, a long aramid fiber, a short aramid fiber, a polyester fiber, a polyamide fiber or a spandex fiber. The fifteenth yarn 37 includes one of a core-spun yarn A9 or a twisted yarn A10.

In the process of kitting a protective textile, acrylic, chenille, a carbon fiber, a copper fiber, a silver fiber and/or a bamboo fiber may be added to be knitted together, so that the gloves can be used for operations in special environments.

Embodiment 10

A knitting method for a protective textile may use single-yarn knitting. Specifically, referring to FIG. 4, FIG. 5, FIG. 6, and FIG. 10, specific implementations of the single-yarn knitting are as follows:

A first step: Manufacture the twisted yarn A10. By using a tungsten wire as a core filament of a yarn, and by using materials such as a long PE fiber, a long aramid fiber, a long Kevlar fiber, a long Dyneema fiber, a polyester fiber, a nylon fiber, a cotton yarn, an acrylic fiber, a chenille yarn, a carbon fiber, a copper fiber, a silver fiber or/and a bamboo fiber, the twisted yarn A10 is manufactured by using a twisted yarn forming process.

A second step: Manufacture the core-spun yarn A9. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the core-spun yarn A9 is manufactured by using a core-spun yarn forming process.

A third step: Manufacture the covered yarn A11. By using a tungsten wire as a core filament of a yarn, and by using the twisted yarn A10 or the core-spun yarn A9 and materials such as a long PE fiber, a long aramid fiber, a long Kevlar fiber, a long Dyneema fiber, a polyester fiber, a nylon fiber, a cotton yarn, an acrylic fiber, a chenille yarn, a carbon fiber, a copper fiber, a silver fiber or/and a bamboo fiber, the covered yarn A11 is manufactured by using a covered yarn forming process.

A fourth step: Knit a protective textile by using the covered yarn A11.

In this embodiment, the protective textile may alternatively be knitted by using the covered yarn B31 as a single yarn. For details, refer to the embodiments shown in FIG. 4, FIG. 5, and FIG. 9.

Figure 10:
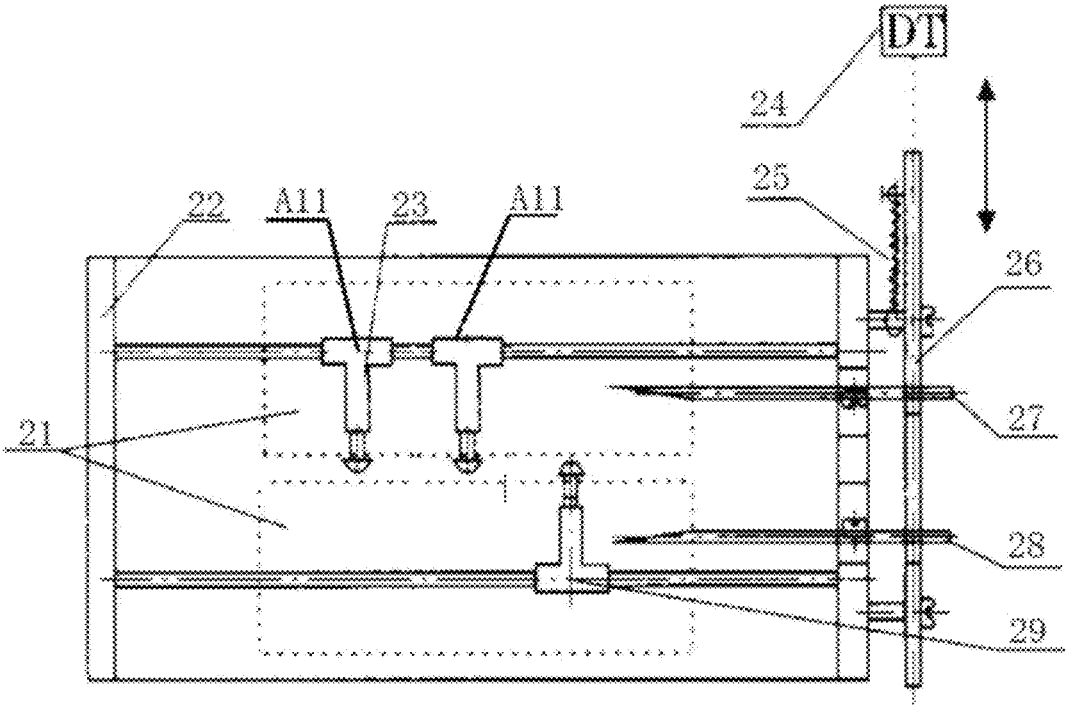
FIG. 10 is a schematic structural diagram of single-yarn knitting.

As shown in FIG. 10, a knitting apparatus includes a primary yarn guide 23, a primary yarn control rod 27 connected to the primary yarn guide 23, a secondary yarn guide 29, and a secondary yarn control rod 28 connected to the secondary yarn guide 29. The primary yarn guide 23 and the secondary yarn guide 29 are mounted on a frame 22. A needle plate 21 is further provided at lower ends of the primary yarn guide 23 and the secondary yarn guide 29. A control cam 26 separately drives the primary yarn control rod 27 to control the primary yarn guide 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down.

The single-yarn knitting method is: placing the covered yarn A11 obtained in the fourth step in this embodiment on the primary yarn guide 23, and knitting gloves by means of the movement of the primary yarn guide 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 11

Figure 11:
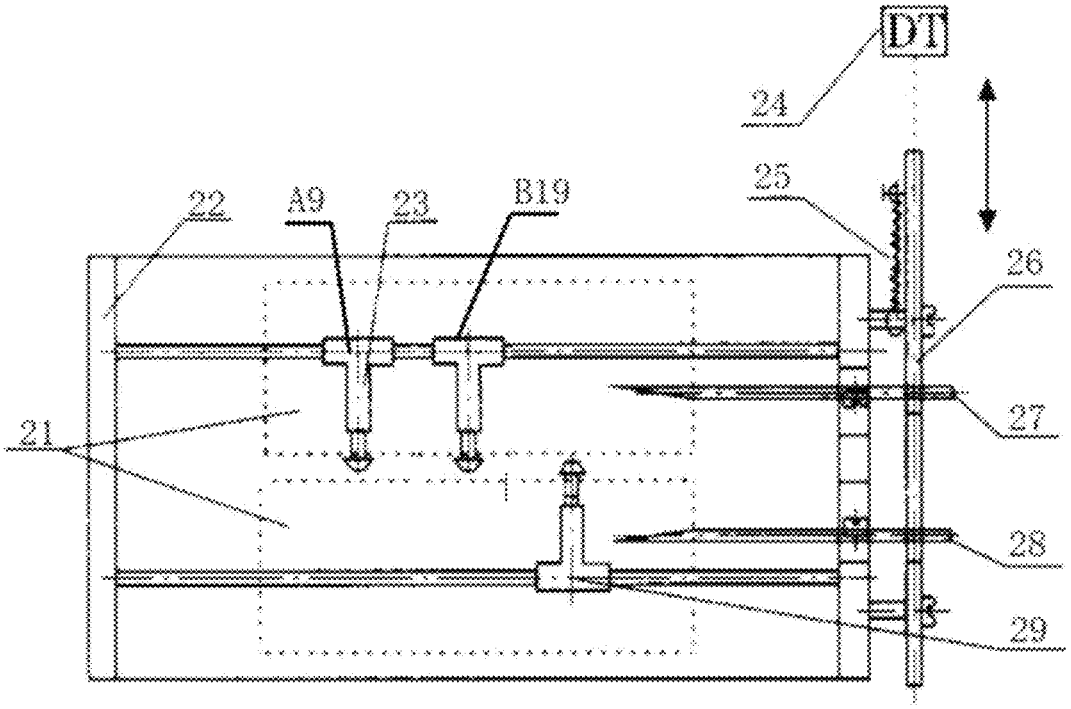
FIG. 11 is a schematic structural diagram of a core-spun yarn A9 and a core-spun yarn B19 in double-yarn knitting.

A knitting method for a protective textile may use double-yarn knitting. An eleventh specific implementation of the double-yarn knitting method is shown in FIG. 11.

A first step: Manufacture a core-spun yarn A9. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the core-spun yarn A9 is manufactured by using a core-spun yarn forming process.

A second step: Manufacture a core-spun yarn B19. By using a spandex fiber as core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the core-spun yarn B19 is manufactured by using a core-spun yarn forming process.

A third step: Primary yarn guides 23 of a knitting apparatus include a primary yarn guide A and a primary yarn guide B. Place the core-spun yarn A9 on the primary yarn guide A, and place the core-spun yarn B19 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the core-spun yarn A9 and the core-spun yarn B19 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 12

Figure 12:
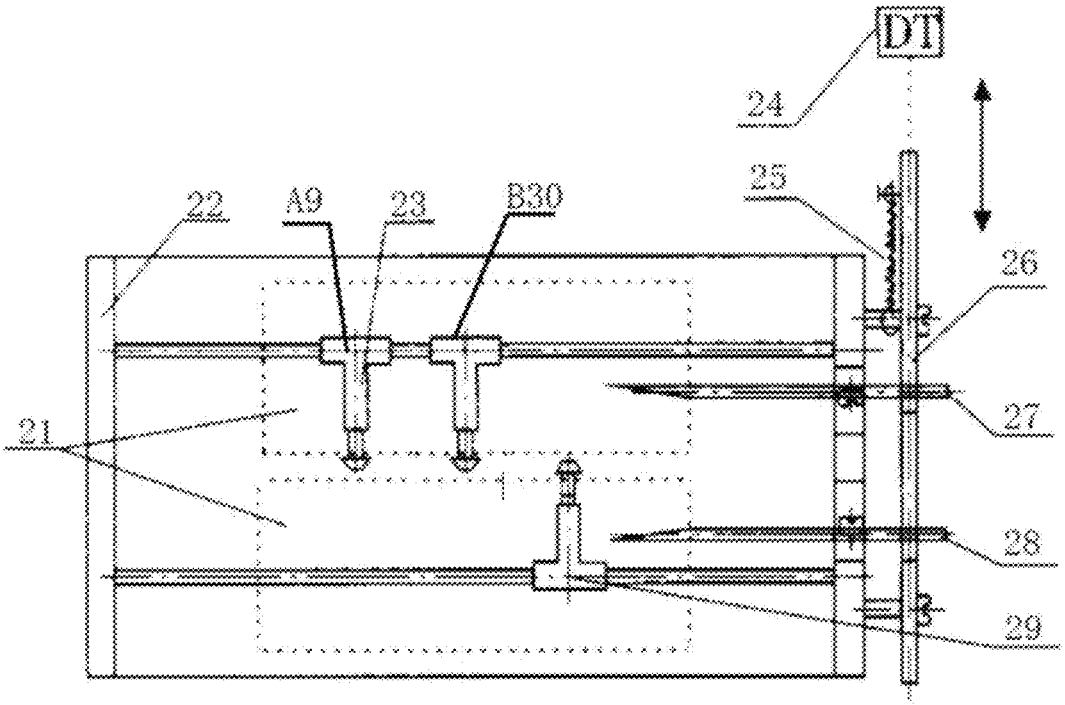
FIG. 12 is a schematic structural diagram of a core-spun yarn A9 and a twisted yarn B30 in double-yarn knitting.

A knitting method for a protective textile may use double-yarn knitting. A twelfth specific implementation of the double-yarn knitting method is shown in FIG. 12.

A first step: Manufacture a core-spun yarn A9. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the core-spun yarn A9 is manufactured by using a core-spun yarn forming process.

A second step: Manufacture a twisted yarn B30. By using a spandex fiber as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the twisted yarn B30 is manufactured by using a core-spun yarn forming process.

A third step: Primary yarn guides 23 of a knitting apparatus include a primary yarn guide A and a primary yarn guide B. Place the core-spun yarn A9 on the primary yarn guide A, and place the twisted yarn B30 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the core-spun yarn A9 and the twisted yarn B30 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 13

Figure 13:
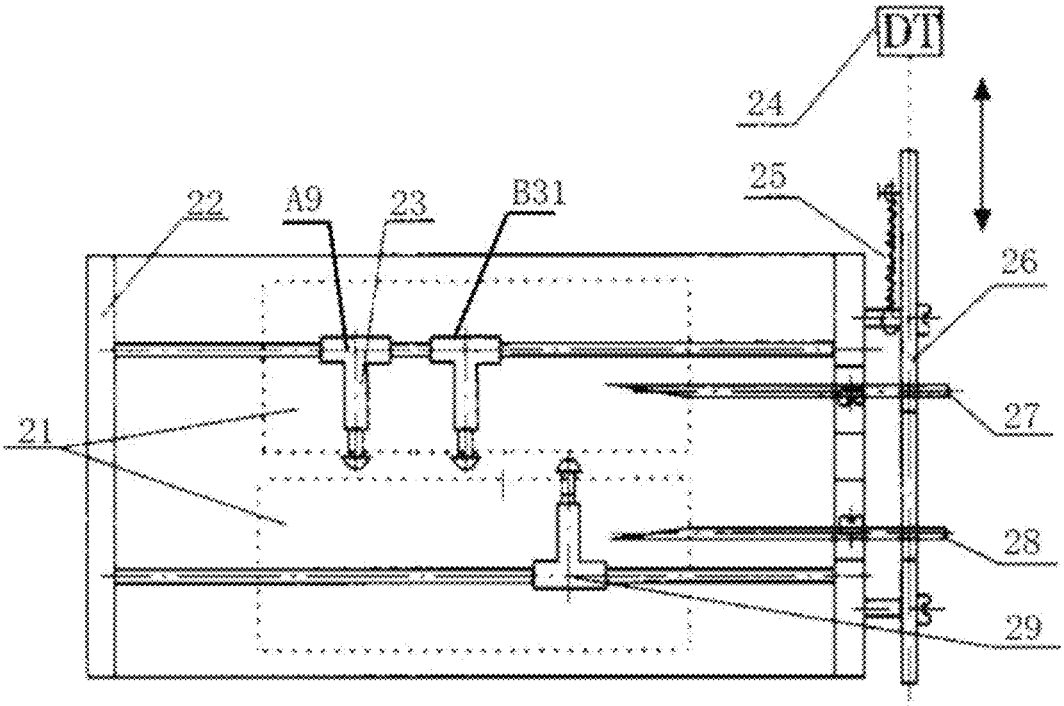
FIG. 13 is a schematic structural diagram of a core-spun yarn A9 and a covered yarn B31 in double-yarn knitting.

A knitting method for a protective textile may use double-yarn knitting. A thirteenth specific implementation of the double-yarn knitting method is shown in FIG. 13.

A first step: Manufacture a core-spun yarn A9. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the core-spun yarn A9 is manufactured by using a core-spun yarn forming process.

A second step: Manufacture a covered yarn B31. By using a spandex fiber as a core filament of a yarn, using one yarn made of one of the materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber as an outer-layer yarn, and using one of the twisted yarn A10 or the core-spun yarn A9 as an outer-layer yarn, the covered yarn B31 is manufactured by using a twisted yarn forming process.

A third step: Primary yarn guides 23 of a knitting apparatus include a primary yarn guide A and a primary yarn guide B. Place the core-spun yarn A9 on the primary yarn guide A, and place the covered yarn B31 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the core-spun yarn A9 and the covered yarn B31 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 14

Figure 14:
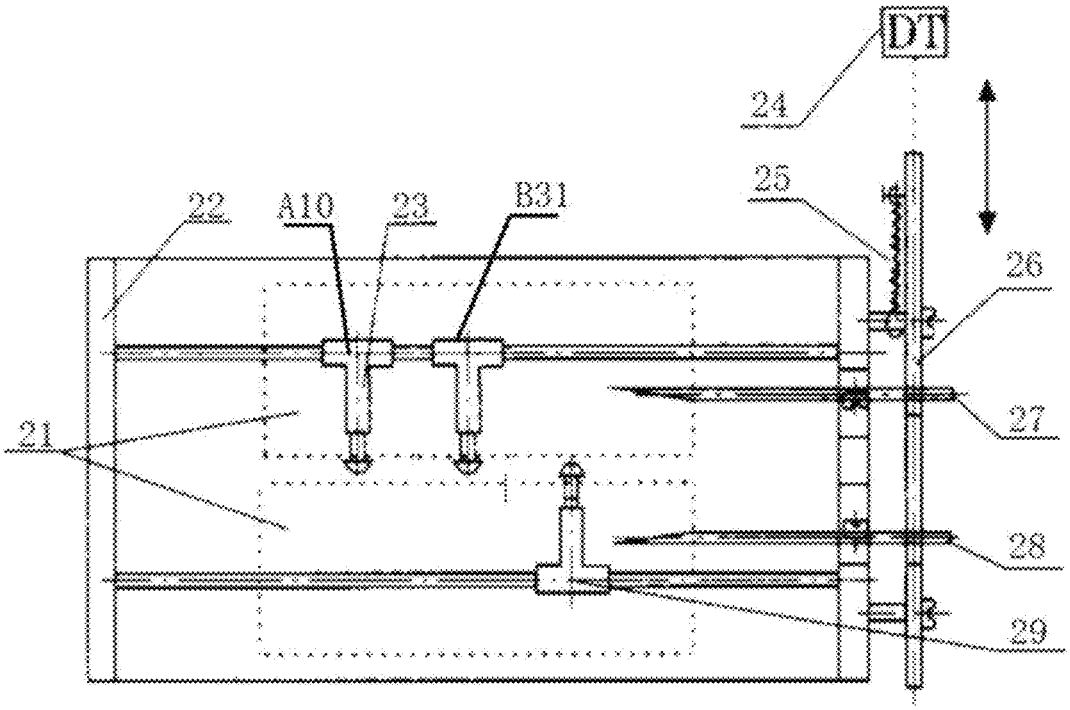
FIG. 14 is a schematic structural diagram of a twisted yarn A10 and a covered yarn B31 in double-yarn knitting.

A knitting method for a protective textile may use double-yarn knitting. A fourteenth specific implementation of the double-yarn knitting method is shown in FIG. 14.

A first step: Manufacture a twisted yarn A10. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the twisted yarn A10 is manufactured by using a core-spun yarn forming process.

A second step: Manufacture a covered yarn B31. By using a spandex fiber as a core filament of a yarn, using one yarn made of one of the materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber as an outer-layer yarn, and using one of the twisted yarn A10 or the core-spun yarn A9 as an outer-layer yarn, the covered yarn B31 is manufactured by using a twisted yarn forming process.

A third step: Primary yarn guides 23 of a knitting apparatus include a primary yarn guide A and a primary yarn guide B. Place the twisted yarn A10 on the primary yarn guide A, and place the covered yarn B31 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the twisted yarn A10 and the covered yarn B31 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 15

Figure 15:
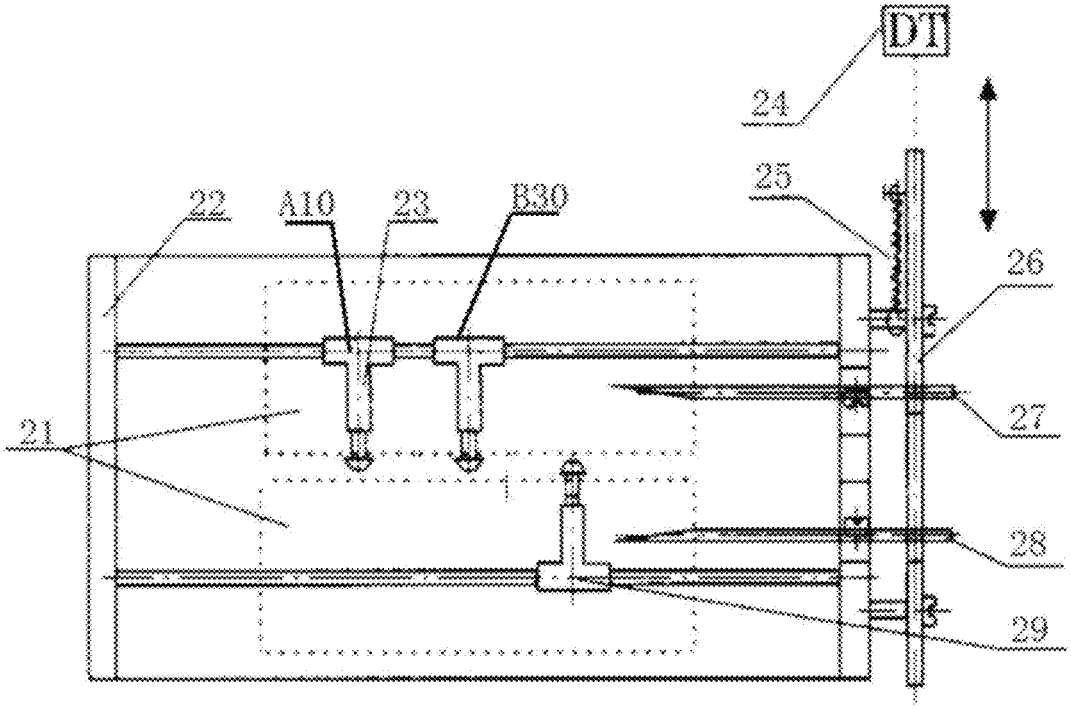
FIG. 15 is a schematic structural diagram of a twisted yarn A10 and a twisted yarn B30 in double-yarn knitting.

A knitting method for a protective textile may use double-yarn knitting. A fifteenth specific implementation of the double-yarn knitting method is shown in FIG. 15.

A first step: Manufacture a twisted yarn A10. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the twisted yarn A10 is manufactured by using a core-spun yarn forming process.

A second step: Manufacture a twisted yarn B30. By using a spandex fiber as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the twisted yarn B30 is manufactured by using a core-spun yarn forming process.

A third step: Primary yarn guides 23 of a knitting apparatus include a primary yarn guide A and a primary yarn guide B. Place the twisted yarn A10 on the primary yarn guide A, and place the twisted yarn B30 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the twisted yarn A10 and the twisted yarn B30 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 16

Figure 16:
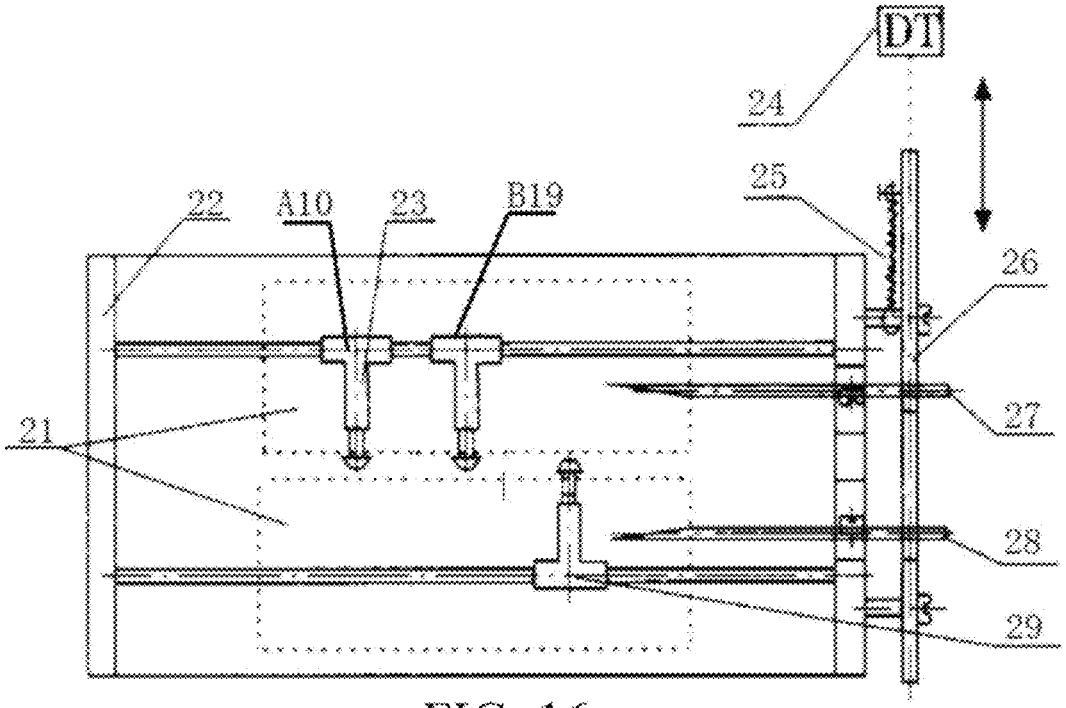
FIG. 16 is a schematic structural diagram of a twisted yarn A10 and a covered yarn B19 in double-yarn knitting.

A knitting method for a protective textile may use double-yarn knitting. A sixteenth specific implementation of the double-yarn knitting method is shown in FIG. 16.

A first step: Manufacture a twisted yarn A10. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the twisted yarn A10 is manufactured by using a twisted yarn forming process.

A second step: Manufacture a core-spun yarn B19. By using a spandex fiber as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the core-spun yarn B19 is manufactured by using a core-spun yarn forming process.

A third step: Primary yarn guides 23 of a knitting apparatus include a primary yarn guide A and a primary yarn guide B. Place the twisted yarn A10 on the primary yarn guide A, and place the core-spun yarn B19 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the twisted yarn A10 and the core-spun yarn B19 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 17

Figure 17:
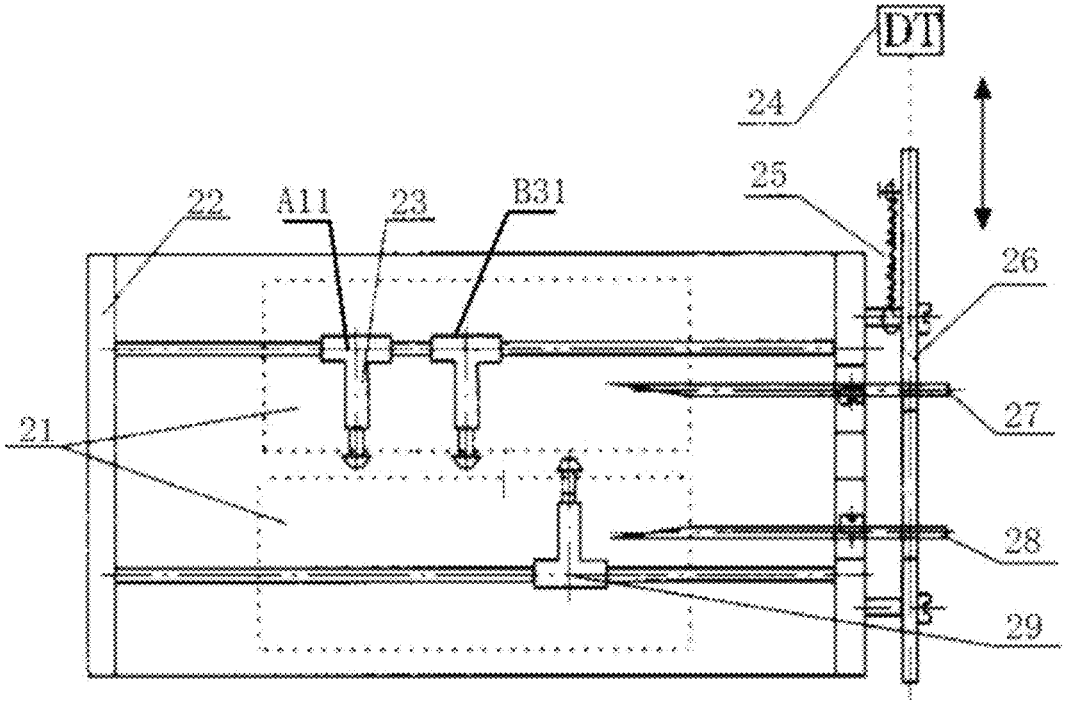
FIG. 17 is a schematic structural diagram of a covered yarn A11 and a covered yarn B31 in double-yarn knitting.

A knitting method for a protective textile may use double-yarn knitting. A seventeenth specific implementation of the double-yarn knitting method is shown in FIG. 17.

A first step: Manufacture a covered yarn A11. By using a tungsten wire as a core filament of a yarn, using one yarn including one of a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or a bamboo fiber as an outer-layer yarn, and using one of the twisted yarn A10 or the core-spun yarn A9 as an outer-layer yarn, the covered yarn A11 is manufactured by using a twisted yarn forming process.

A second step: Manufacture a covered yarn B31. By using a spandex fiber as a core filament of a yarn, using one yarn including one of a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or a bamboo fiber as an outer-layer yarn, and using one of the twisted yarn A10 or the core-spun yarn A9 as an outer-layer yarn, the covered yarn B31 is manufactured by using a twisted yarn forming process.

A third step: Primary yarn guides 23 of a knitting apparatus include a primary yarn guide A and a primary yarn guide B. Place the covered yarn A11 on the primary yarn guide A, and place the covered yarn B31 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the covered yarn A11 and the covered yarn B31 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 18

Figure 18:
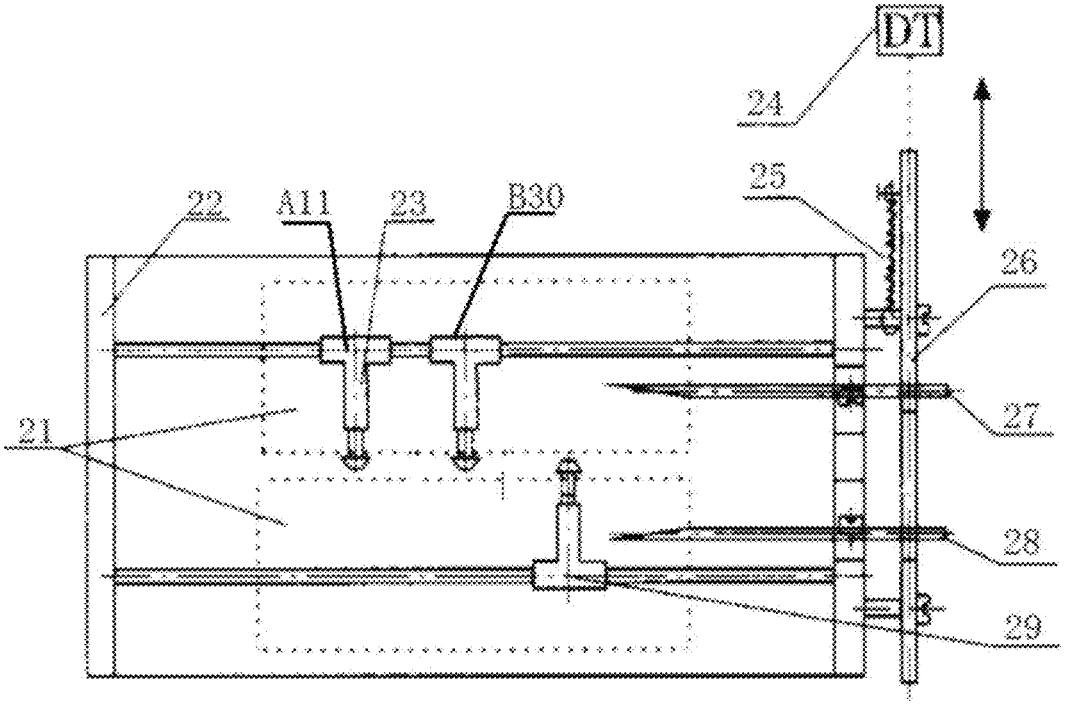
FIG. 18 is a schematic structural diagram of a covered yarn A11 and a twisted yarn B30 in double-yarn knitting.

A knitting method for a protective textile may use double-yarn knitting. An eighteenth specific implementation of the double-yarn knitting method is shown in FIG. 18.

A first step: Manufacture a covered yarn A11. By using a tungsten wire as a core filament of a yarn, using one yarn including one of a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or a bamboo fiber as an outer-layer yarn, and using one of the twisted yarn A10 or the core-spun yarn A9 as an outer-layer yarn, the covered yarn A11 is manufactured by using a twisted yarn forming process.

A second step: Manufacture a twisted yarn B30. By using a spandex fiber as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the twisted yarn B30 is manufactured by using a core-spun yarn forming process.

A third step: Primary yarn guides 23 of a knitting apparatus include a primary yarn guide A and a primary yarn guide B. Place the covered yarn A11 on the primary yarn guide A, and place the twisted yarn B30 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the covered yarn A11 and the twisted yarn B30 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

Embodiment 19

Figure 19:
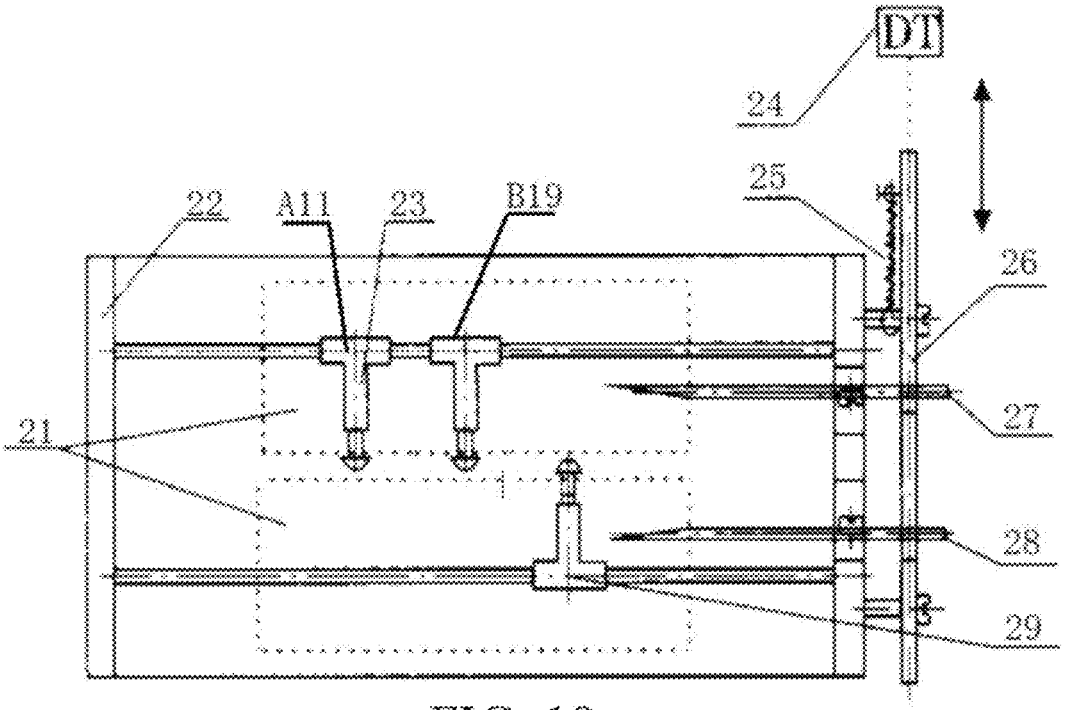
FIG. 19 is a schematic structural diagram of a covered yarn A11 and a core-spun yarn B19 in double-yarn knitting.

A knitting method for a protective textile may use double-yarn knitting. A nineteenth specific implementation of the double-yarn knitting method is shown in FIG. 19.

A first step: Manufacture a core-spun yarn B19. By using a tungsten wire as a core filament of a yarn, and by using materials such as a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or/and a bamboo fiber, the core-spun yarn B19 is manufactured by using a core-spun yarn forming process.

A second step: Manufacture a covered yarn A11. By using a spandex fiber as a core filament of a yarn, using one yarn including one of a short PE fiber, a short aramid fiber, a short Kevlar fiber, a short Dyneema fiber, a polyester fiber, a nylon fiber, a cotton yarn, an acrylic fiber, a chenille yarn, a carbon fiber, a copper fiber, a silver fiber or a bamboo fiber as an outer-layer yarn, and using one of the twisted yarn A10 or the core-spun yarn A9 as an outer-layer yarn, the covered yarn A11 is manufactured by using a twisted yarn forming process.

A third step: Primary yarn guides 23 of a knitting apparatus include a primary yarn guide A and a primary yarn guide B. Place the core-spun yarn B19 on the primary yarn guide A, and place the covered yarn A11 on the primary yarn guide B. The knitting apparatus further includes a primary yarn control rod 27 connected to the primary yarn guides 23, a secondary yarn guide 29, and a secondary yarn control rod 28 connected to the secondary yarn guide 29. The primary yarn guides 23 and the secondary yarn guide 29 are mounted on a frame 22. A needle plate 21 is further provided at lower ends of the primary yarn guides 23 and the secondary yarn guide 29. A control cam 26 separately drives the primary yarn control rod 27 to control the primary yarn guides 23 to move and drives the secondary yarn control rod 28 to control the secondary yarn guide 29 to move. The control cam 26 is connected to a tension spring 25. A magnetic force of an electromagnet 24 can drive the tension spring 25 to extend and retract, and further drive the control cam 26 to rotate up and down. The double-yarn knitting method is: knitting gloves by driving the core-spun yarn B19 and the covered yarn A11 to move by means of the movement of the primary yarn guides 23. To achieve that the gloves can be used for operations in special environments, yarns such as an acrylic fiber, a chenille yarn, a carbon fiber, a copper fiber, a silver fiber, or/and a bamboo fiber may further be added and knitted together in a glove knitting process. This knitting method is applicable to a machine with any gauge of 7G, 10G, 13G, 15G, 18G or 24G.

The foregoing embodiments only list specific embodiments in which a protective textile is knitted by combining a tungsten wire as a core filament of a yarn and a spandex fiber as a core filament of a yarn. The present invention may further list embodiments in which a protective textile is knitted by combining a tungsten wire as a core filament of a yarn and another cut resistant material as a core filament of a yarn. The another cut resistant material may be one or more of a PE fiber, a steel wire, a basalt fiber, a Kevlar fiber or a Dyneema fiber. Embodiments of other cut resistant materials are obtained through simple replacement of materials of a same type, and are therefore not enumerated in the embodiments of the present invention.

Figure 20:
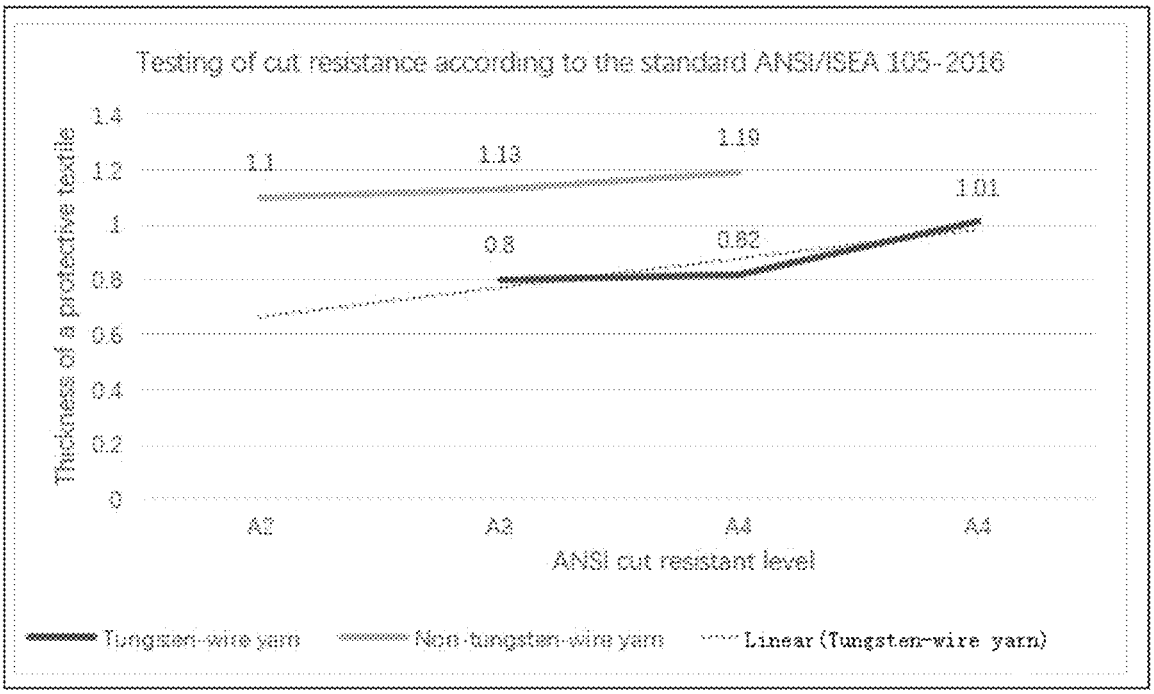
FIG. 20 is a diagram of comparison of cut resistance according to the standard ANSI/ISEA 105-2016 of protective textiles produced by using a tungsten-wire yarn and a non-tungsten-wire yarn.

Referring to FIG. 20, FIG. 20 is a diagram of comparison of cut resistance of a protective textile knitted by using a tungsten-wire yarn and a protective textile knitted by using a non-tungsten-wire yarn. Referring to FIG. 20, for the protective textile to which a tungsten-wire yarn is not added: when the thickness of the protective textile is 1.1 mm, a corresponding ANSI cut resistant level is A2; when the thickness of the protective textile is 1.13 mm, a corresponding ANSI cut resistant level is A3; when the thickness of the protective textile is 1.19 mm, a corresponding ANSI cut resistant level is A4. For the protective textile to which a tungsten-wire yarn is added, corresponding parameters are: when the thickness of the protective textile is 0.8 mm, a corresponding ANSI cut resistant level is A3; when the thickness of the protective textile is 0.82 mm, a corresponding ANSI cut resistant level is A4; when the thickness of the protective textile is 1.01 mm, a corresponding ANSI cut resistant level is A5. It can be obviously seen from the figure that when a protective textile is knitted by adding a tungsten-wire yarn, the protective textile is lighter, can be operated more flexibly, does not cause an itch of the body skin, and is completely in conformity with the ANSI cut resistant level standard. The embodiments above merely describe implementations of the present invention, which are described in detail. All changes that are made by a person of ordinary skill in the art without departing from the concept of the present invention after the person views the embodiments of the present invention shall fall within the protection scope of the present invention. However, the embodiments described in this specification should not be understood as limitations to the protection scope of the present invention.

What is claimed is:

1. A knitting method for a protective textile comprising:
twisting and winding a first bamboo fiber around a first tungsten core to form a first twisted yarn;
placing the first twisted yarn into a first yarn guide mounted on a frame of a knitting apparatus;
twisting and winding a second bamboo fiber around a second tungsten wire to form a second twisted yarn twisting and winding the second twisted yarn and a chenille yarn around a spandex core to form a covered yarn;
placing the covered yarn into a second yarn guide mounted on the frame;
driving a yarn control rod to move the first and second yarn guides for knitting the first twisted yarn and the covered yarn together to yield a protective textile.

2. The knitting method of claim 1, wherein the yarn control rod is operably coupled to a control cam and driving the yarn control rod comprises rotating the control cam up and down to move the yarn control rod.

3. The knitting method of claim 2, wherein the control cam is operably coupled to a tension spring and driving the yarn control rod further comprises extending and retracting the tension spring to rotate the control cam.

4. The knitting method according to claim 1, a cross-sectional diameter of the tungsten wire is 30 microns.

5. The knitting method according to claim 4, a cut resistant level of the protective textile is A4.

6. The knitting method according to claim 1, a machine gauge of the knitting apparatus is 7G.

7. A knitting method for a protective textile comprising:
twisting and winding a first carbon fiber around a first tungsten core to form a first twisted yarn;
placing the first twisted yarn into a first yarn guide mounted on a frame of a knitting apparatus;
twisting and winding a second carbon fiber around a second tungsten core to form a second twisted yarn twisting and winding the second twisted yarn and a chenille yarn around a spandex core to form a covered yarn;
placing the covered yarn into a second yarn guide mounted on the frame;
driving a yarn control rod to move the first and second yarn guides for knitting the first twisted yarn and the covered yarn together to yield a protective textile.

8. The knitting method according to claim 7, a cross-sectional diameter of the tungsten wire is 40 microns.

9. The knitting method according to claim 8, a cut resistant level of the protective textile is A5.

10. The knitting method according to claim 7, a machine gauge of the knitting apparatus is 24G.

11. The knitting method of claim 7, wherein the yarn control rod is operably coupled to a control cam and driving the yarn control rod comprises rotating the control cam up and down to move the yarn control rod.

12. The knitting method of claim 11, wherein the control cam is operably coupled to a tension spring and driving the yarn control rod further comprises extending and retracting the tension spring to rotate the control cam.

* * * * *